US009393682B2

(12) United States Patent
Green et al.

(10) Patent No.: US 9,393,682 B2
(45) Date of Patent: Jul. 19, 2016

(54) FOLDING TOOL ASSEMBLY

(71) Applicant: Kai U.S.A., Ltd., Tualatin, OR (US)

(72) Inventors: Craig Donald Kemp Green, Newberg, OR (US); James MacNair, Newberg, OR (US)

(73) Assignee: Kai U.S.A., Ltd., Tualatin, OR (US)

( * ) Notice: Subject to any disclaimer, the term of this patent is extended or adjusted under 35 U.S.C. 154(b) by 115 days.

(21) Appl. No.: 14/137,776

(22) Filed: Dec. 20, 2013

(65) Prior Publication Data

US 2014/0173910 A1 Jun. 26, 2014

Related U.S. Application Data

(60) Provisional application No. 61/745,351, filed on Dec. 21, 2012.

(51) Int. Cl.
*B26B 1/04* (2006.01)
*B25F 1/04* (2006.01)

(52) U.S. Cl.
CPC .... *B25F 1/04* (2013.01); *B26B 1/04* (2013.01)

(58) Field of Classification Search
CPC ..... B26B 1/00–1/06; B26B 1/10; B26B 11/00–11/008; B25F 1/045
USPC ..... 30/151, 152, 153, 155, 158, 159, 160, 30/161, 156, 157; 7/118–120, 128, 158, 7/168
See application file for complete search history.

(56) References Cited

U.S. PATENT DOCUMENTS

| | | | | |
|---|---|---|---|---|
| 3,890,858 | A * | 6/1975 | Lawson et al. | 30/90.1 |
| 4,245,911 | A * | 1/1981 | Steinbrenner | G01J 3/06 356/328 |
| 6,006,385 | A * | 12/1999 | Kershaw | B25F 1/04 7/128 |
| 6,145,202 | A | 11/2000 | Onion | |
| 6,170,104 | B1 * | 1/2001 | Seber et al. | 7/128 |
| 6,397,476 | B1 | 6/2002 | Onion | |
| 6,594,906 | B1 * | 7/2003 | Sakai | B26B 1/046 30/155 |
| D538,138 | S * | 3/2007 | Knight | D8/356 |
| 7,340,836 | B2 * | 3/2008 | Whitemiller et al. | 30/152 |
| 7,353,736 | B2 * | 4/2008 | Poehlmann | B25F 1/04 30/161 |
| 7,634,956 | B2 * | 12/2009 | Rivera | B25F 1/003 7/118 |
| RE42,906 | E * | 11/2011 | Onion | B26B 1/044 30/160 |

(Continued)

FOREIGN PATENT DOCUMENTS

WO WO 2011121396 A1 * 10/2011 ..... B25B 15/008

*Primary Examiner* — Stephen Choi
*Assistant Examiner* — Evan MacFarlane
(74) *Attorney, Agent, or Firm* — Alleman Hall McCoy Russell & Tuttle LLP

(57) ABSTRACT

A folding knife includes a handle assembly, a blade, and a secondary tool. The blade is pivotally connected to the handle assembly and is configured to pivot from a closed position to an opened position. The secondary tool is pivotally connected to the handle assembly and is configured to pivot from a closed position to an opened position. The secondary tool includes a locking member that traps the blade in the closed position when the secondary tool is in the opened position but allows the blade to pivot to the opened position when the secondary tool is in the closed position.

20 Claims, 4 Drawing Sheets

(56) References Cited

U.S. PATENT DOCUMENTS

2001/0016987 A1* 8/2001 Chen ..... 30/161
2003/0079294 A1* 5/2003 Van Deursen et al. ..... 7/118
2003/0106159 A1* 6/2003 Ackeret ..... B26B 11/00 7/160
2005/0278956 A1* 12/2005 Ling ..... B26B 1/04 30/161
2006/0174490 A1* 8/2006 Galyean ..... B26B 1/04 30/153
2006/0277762 A1* 12/2006 Knight ..... B26B 1/02 30/153
2008/0216326 A1* 9/2008 Klecker et al. ..... 30/161
2008/0271257 A1* 11/2008 Frazer ..... 7/158
2009/0293285 A1* 12/2009 Goodrich ..... 30/153
2010/0024221 A1* 2/2010 Hernandez ..... B26B 5/003 30/296.1
2013/0174676 A1* 7/2013 Kim ..... B60H 1/0065 74/54

* cited by examiner

FOLDING TOOL ASSEMBLY

CROSS REFERENCE TO RELATED APPLICATIONS

This application claims priority to U.S. Provisional Patent Application No. 61/745,351, entitled FOLDING TOOL ASSEMBLY, filed Dec. 21, 2012, the entirety of which is hereby incorporated herein by reference.

BACKGROUND

Knives and/or other tools can be combined together in folding tools. Various tools can be selected for inclusion on a given folding tool based on the desired functionality of the folding tool. In general, it is desirable to increase the utility of the folding tool while also increasing the safety of the folding tool.

SUMMARY

A folding knife includes a handle assembly, a blade, and a secondary tool. The blade is pivotally connected to the handle assembly and is configured to pivot from a closed position to an opened position. The secondary tool is pivotally connected to the handle assembly and is configured to pivot from a closed position to an opened position. The secondary tool includes a locking member that traps the blade in the closed position when the secondary tool is in the opened position but allows the blade to pivot to the opened position when the secondary tool is in the closed position.

DETAILED DESCRIPTION

Figure 1A:
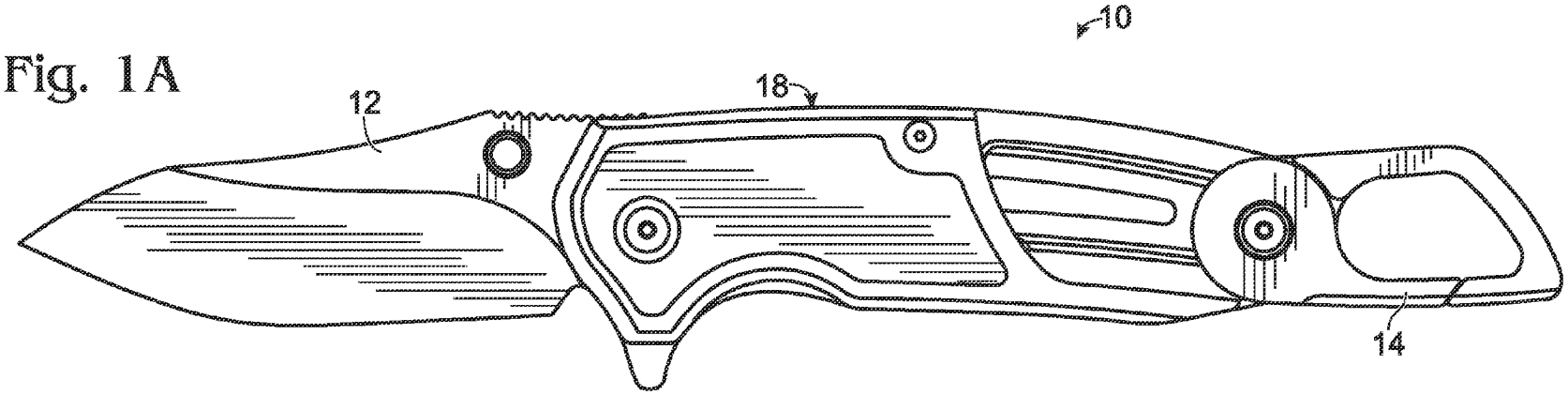
FIG. 1A shows an example folding tool assembly with both a primary tool and a secondary tool in an opened position.
Figure 1B:
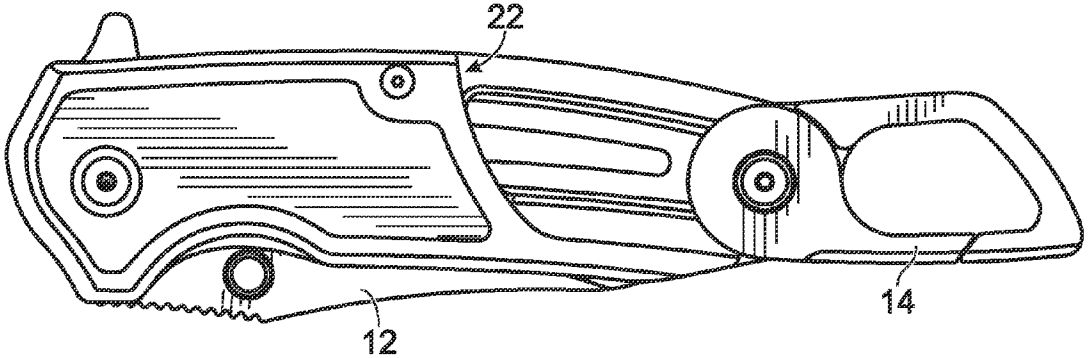
FIG. 1B shows the folding tool assembly of FIG. 1A with the secondary tool in a closed position.
Figure 2:
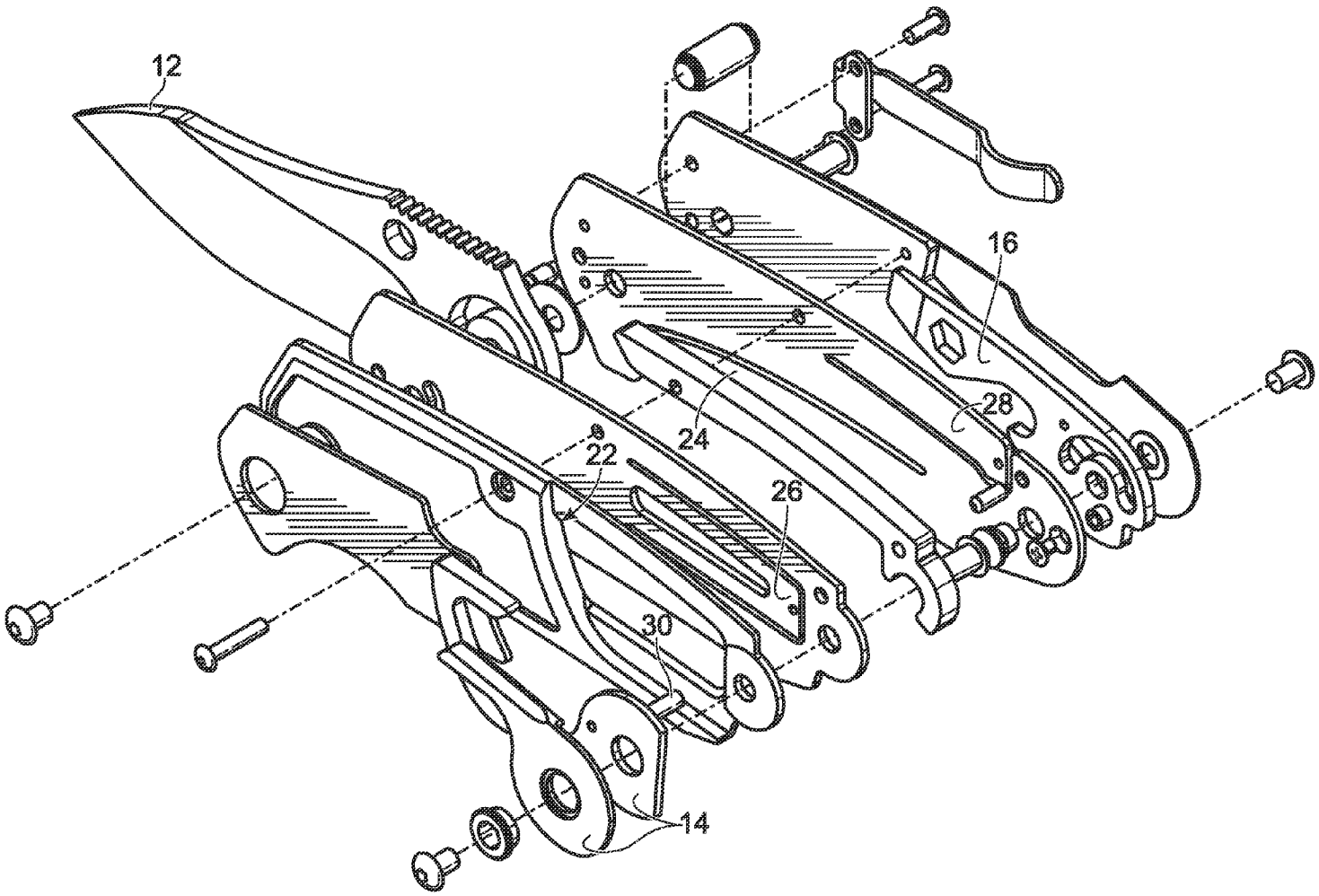
FIG. 2 shows an exploded view of the folding tool assembly of FIGS. 1A and 1B.

FIGS. 1-4B show a nonlimiting example of a folding tool assembly 10 in accordance with an embodiment of the present disclosure. In the illustrated example, the folding tool assembly includes a primary tool in the form of a blade 12, a secondary tool in the form of a carabiner 14, and a tertiary tool in the form of a multi-tool 16 with screwdriver, wrench, and opener functionality. However, it should be understood that these example tools are nonlimiting. Folding tool assemblies in accordance with the present disclosure may include more, fewer, and/or different tools.

The folding tool assembly includes a handle assembly 18 to which each of the primary, secondary, and tertiary tools is pivotably connected. Each of the pivoting tools is configured to pivot from a closed position to an opened position, and vice versa, relative to the handle assembly.

Figure 4A:
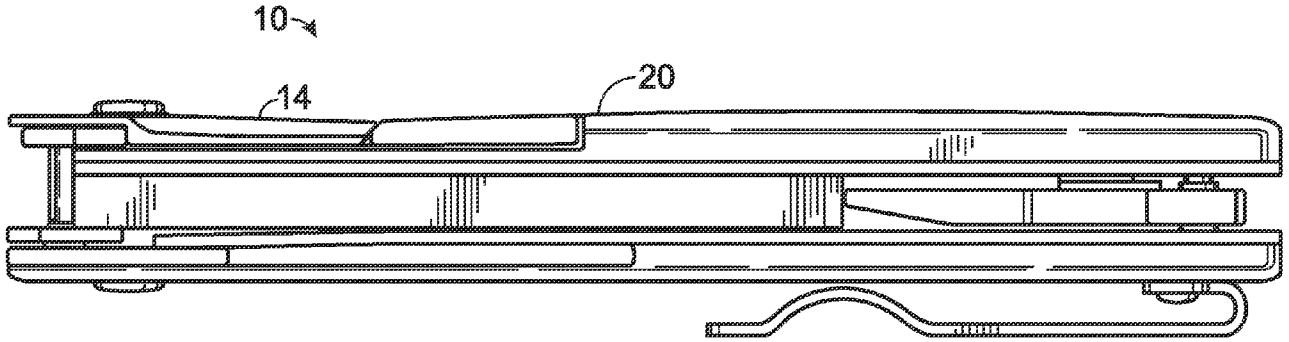
FIG. 4A shows the folding tool assembly of FIGS. 1A and 1B with both a primary tool and a secondary tool in a closed position.

The handle assembly may be configured such that one or more of the tools is substantially flush with a gripping surface of the handle assembly when that tool is in the closed position. For example, as shown in FIG. 4A, the carabiner 14 is substantially flush with the gripping surface 20. As such, the carabiner is fully visible, even when in the closed position. In such a configuration, the carabiner pivots in the same plane as the gripping surface of the handle assembly. To accommodate the carabiner in the closed position, the handle assembly has a recessed portion 22.

In contrast to the carabiner, the blade and the tertiary tool are not flush with the gripping surface of the handle assembly. Instead, the blade is protected between opposing gripping surfaces, and the tertiary tool is positioned between a gripping surface and the blade.

Figure 4B:
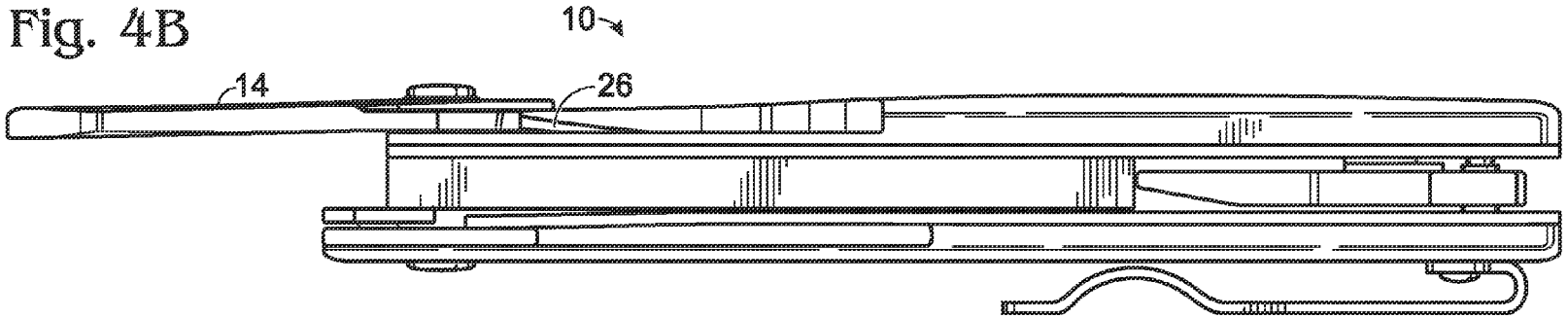
FIG. 4B is shows the folding tool assembly of FIG. 4A with the secondary tool in an opened position.

In the illustrated embodiment, each of the primary, secondary, and tertiary tools can be selectively locked in the opened position by a liner lock 24, liner lock 26, and liner lock 28, respectively. In general, the handle assembly may include a liner lock that is biased towards a folding plane of a tool (e.g., a folding plane of the blade). When the tool is in the closed position, the tool prevents the liner lock from moving into the folding plane. When the tool is in the opened position, the liner lock is free to move into the folding plane. Using the secondary tool as an example, FIG. 4B shows the liner lock 26 moved into the folding plane and engaging a tang of the secondary tool such that the secondary tool cannot be pivoted to the closed position unless the liner lock 26 is manually moved out of the folding plane of the secondary tool. U.S. Pat. Nos. 6,145,202 and 6,397,476, which are hereby incorporated herein by reference for all purposes, describe a nonlimiting example of a liner lock. It is to be understood that different types of liner locks, other types of locks, or no locks at all, may be used without departing from the scope of this disclosure. Further, while the illustrated embodiment includes a lock for each of the primary, secondary, and tertiary tools, it is to be understood that one to all of the tools may be implemented without a lock.

Figure 3A:
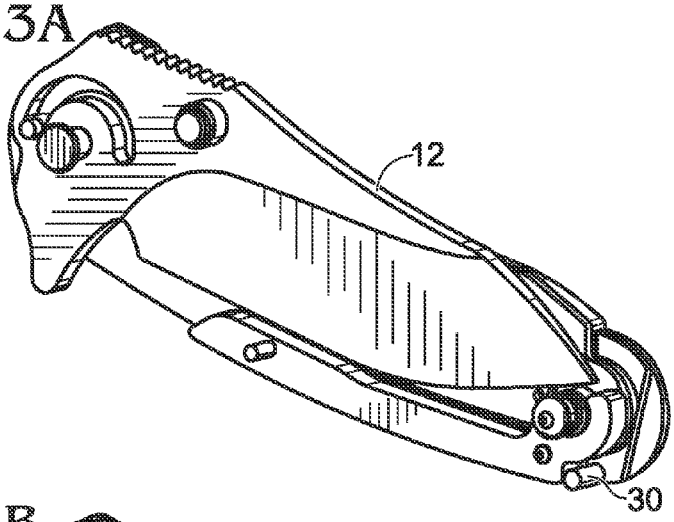
FIG. 3A shows a partial view of the folding tool assembly of FIG. 1 with both a primary tool and a secondary tool in a closed position.
Figure 3B:
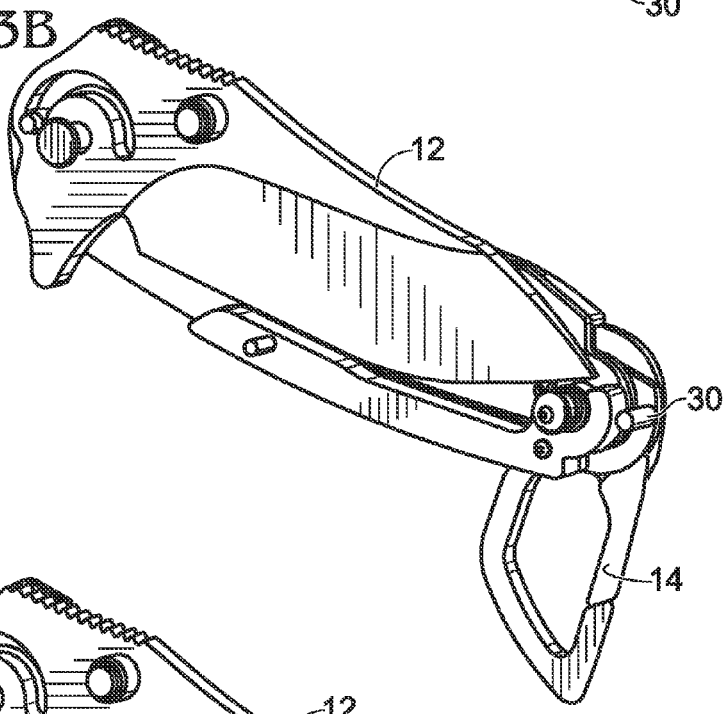
FIG. 3B shows the partial view of FIG. 3A with the secondary tool pivoting from the closed position to an opened position.
Figure 3C:
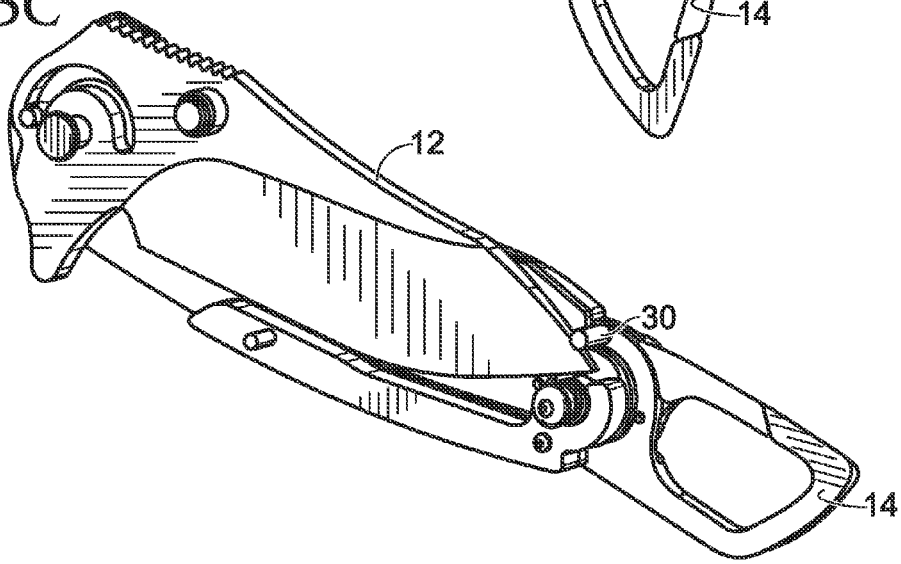
FIG. 3C shows the partial view of FIGS. 3A and 3B with the secondary tool in an opened position.

Additionally or alternatively, one or more locks may be used to lock a tool in the closed position. For example, as best shown in FIGS. 3A-3B, a secondary tool, such as the carabiner 14, may include a locking member 30 that traps a primary tool, such as the blade 12, in the closed position when the secondary tool is in the opened position. In the illustrated embodiment, the locking member 30 is a post that extends from a tang of the carabiner in a direction that is perpendicular to a folding plane of the carabiner.

In this way, both the primary tool and the secondary tool may be freely opened when both tools are in the closed position. However if the secondary tool is opened while the primary tool is closed, the secondary tool will effectively lock the primary tool in the closed position. For example, when the carabiner 14 is opened, the blade 12 is trapped closed by the post extending from the tang of the carabiner. Furthermore, because the carabiner may be locked open by a liner lock, the blade will remained trapped until a user deactivates the liner lock 26 and moves the carabiner to the closed position. Such a configuration prevents the blade from accidentally opening when the carabiner is deployed.

In some embodiments, bias elements may be used to assist the primary, secondary, and/or tertiary tools from an intermediate position to the opened position. A bias element also may be configured to resist pivoting the tool from the closed position to the intermediate position. As such, the bias element can help prevent the tool from accidentally opening, but can assist a user with the opening after the user initiates the opening procedure. U.S. Pat. Nos. 6,145,202 and 6,397,476, which are hereby incorporated herein by reference for all purposes, describe example bias elements.

It will be understood that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various tool features disclosed herein, as well as any and all equivalents thereof.

The invention claimed is:

1. A folding knife, comprising:

a handle assembly;

a blade pivotally connected to the handle assembly and configured to pivot from a closed position to an opened position; and a secondary tool pivotally connected to the handle assembly and configured to pivot from a closed position to an opened position, the secondary tool including a post extending from a tang of the secondary tool into a folding plane of the blade in a direction perpendicular to a folding plane of the secondary tool, the post positioned to block rotation of the blade and thereby trap the blade in the closed position when the secondary tool is in the opened position and positioned out of a rotation path of the blade when the secondary tool is in the closed position, thereby allowing the blade to pivot to the opened position.

2. The folding knife of claim 1, where the secondary tool is a carabiner.

3. The folding knife of claim 1, where the handle assembly includes a gripping surface, and where the secondary tool is flush with the gripping surface when the secondary tool is in the closed position.

4. The folding knife of claim 3, where the secondary tool is a carabiner.

5. The folding knife of claim 1, where the handle assembly includes a liner lock to lock the blade in the opened position.

6. The folding knife of claim 1, where the handle assembly includes a liner lock to lock the secondary tool in the opened position.

7. The folding knife of claim 1, further comprising a tertiary tool pivotally connected to the handle assembly and configured to pivot from a closed position to an opened position.

8. The folding knife of claim 7, where the handle assembly includes a gripping surface, and where the tertiary tool is between a plane of the gripping surface and the folding plane of the blade.

9. The folding knife of claim 7, where the blade is positioned between the folding plane of the secondary tool and a folding plane of the tertiary tool.

10. The folding knife of claim 1, where the post extending from the tang of the secondary tool is an elongate post that extends from a side of the tang and has a length in the direction perpendicular to the folding plane of the secondary tool sufficient to extend into the folding plane of the blade.

11. The folding knife of claim 1, where the blade has a cutting side and a back side opposite the cutting side, and the post extends into the rotation path of the blade when the secondary tool is in the opened position, the post trapping the blade in the closed position by blocking the back side of the blade.

12. A folding tool assembly, comprising:

a handle assembly including a gripping surface;

a primary tool pivotally connected to the handle assembly and configured to pivot from a closed position to an opened position; and a carabiner pivotally connected to the handle assembly and configured to pivot from a closed position to an opened position, the carabiner including a post extending from a tang of the carabiner into a folding plane of the primary tool in a direction perpendicular to a folding plane of the carabiner, the post positioned to block rotation of the primary tool and thereby trap the primary tool in the closed position when the carabiner is in the opened position and positioned out of a rotation path of the primary tool when the carabiner is in the closed position, thereby allowing the primary tool to pivot to the opened position.

13. The folding tool assembly of claim 12, where the handle assembly includes a liner lock to lock the carabiner in the opened position.

14. The folding tool assembly of claim 12, where the post extending from the tang of the carabiner is an elongate post that extends from a side of the tang and has a length in the direction perpendicular to the folding plane of the carabiner sufficient to extend into the folding plane of the primary tool.

15. A folding tool assembly, comprising:

a handle assembly;

a primary tool pivotally connected to the handle assembly and configured to pivot from a closed position to an opened position; and a secondary tool pivotally connected to the handle assembly and configured to pivot from a closed position to an opened position, the secondary tool including a post extending from a tang of the secondary tool into a folding plane of the primary tool in a direction perpendicular to a folding plane of the secondary tool, the post positioned to block rotation of the primary tool and thereby trap the primary tool in the closed position when the secondary tool is in the opened position and positioned out of a rotation path of the primary tool when the secondary tool is in the closed position, thereby allowing the primary tool to pivot to the opened position.

16. The folding tool assembly of claim 15, where the secondary tool is a carabiner.

17. The folding tool assembly of claim 15, where the handle assembly includes a gripping surface, and where the secondary tool is flush with the gripping surface when the secondary tool is in the closed position.

18. The folding tool assembly of claim 15, where the handle assembly includes a liner lock to lock the secondary tool in the opened position.

19. The folding tool assembly of claim 15, where the primary tool is a blade.

20. The folding tool assembly of claim 15, where the post extending from the tang of the secondary tool is an elongate post that extends from a side of the tang and has a length in the direction perpendicular to the folding plane of the secondary tool sufficient to extend into the folding plane of the primary tool.

* * * * *